US006978749B2

(12) United States Patent
Simpson

(10) Patent No.: US 6,978,749 B2
(45) Date of Patent: Dec. 27, 2005

(54) MEANS TO ADD TORSIONAL ENERGY TO A CAMSHAFT

(75) Inventor: Roger T. Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/918,781

(22) Filed: Aug. 13, 2004

(65) Prior Publication Data

US 2005/0087160 A1 Apr. 28, 2005

Related U.S. Application Data

(60) Provisional application No. 60/515,044, filed on Oct. 27, 2003.

(51) Int. Cl.[7] ..... F01L 1/32

(52) U.S. Cl. ..... 123/90.28; 123/90.6; 123/90.2; 123/90.48; 123/90.31; 123/90.17; 251/256

(58) Field of Search ..... 123/90.6, 90.17, 123/90.31, 90.48, 90.2, 90.28; 251/256

(56) References Cited

U.S. PATENT DOCUMENTS

| | | | | |
|---|---|---|---|---|
| 3,853,101 A * | 12/1974 | Iskenderian et al. | ..... | 123/90.28 |
| 5,002,023 A | 3/1991 | Butterfield et al. | ..... | 123/90.15 |
| 5,040,500 A | 8/1991 | Reece | ..... | 123/90.27 |
| 5,107,805 A | 4/1992 | Butterfiled et al. | ..... | 123/90 |
| 5,235,939 A | 8/1993 | Levin et al. | ..... | 123/90.15 |
| 5,297,507 A * | 3/1994 | Ma | ..... | 123/90.17 |
| 5,564,373 A | 10/1996 | Hara | ..... | 123/90.16 |
| 5,873,335 A | 2/1999 | Wright et al. | ..... | 123/90.11 |
| 6,000,298 A * | 12/1999 | Kato | ..... | 74/569 |

FOREIGN PATENT DOCUMENTS

| | | | | |
|---|---|---|---|---|
| EP | 0849438 A1 | 6/1998 | ..... | F01L 1/46 |
| FR | 2688563 | 9/1993 | ..... | F01L 31/16 |
| FR | 2767154 | 2/1999 | ..... | F01L 1/047 |
| JP | 07332026 | 12/1995 | ..... | F01L 1/04 |

* cited by examiner

*Primary Examiner*—Thomas Denion
*Assistant Examiner*—Kyle M. Riddle
(74) *Attorney, Agent, or Firm*—Brown & Michaels, PC; Greg Dziegielewski

(57) ABSTRACT

A device for providing additional torsional energy for a cam shaft is provided. The device includes at least one main cam lobe formed on a rotating shaft; a valve operating mechanism disposed to be engaged by the main cam lobe; and an outer cylinder encompassing the valve operating mechanism, and capable of movement that is independent of the valve operating mechanism, the outer cylinder being disposed to provide torsional energy to the rotating shaft.

7 Claims, 7 Drawing Sheets

MEANS TO ADD TORSIONAL ENERGY TO A CAMSHAFT

REFERENCE TO PROVISIONAL APPLICATION

This application claims an invention which was disclosed in Provisional Application No. 60/515,044 filed Oct. 27, 2003 entitled "MEANS TO ADD TORSIONAL ENERGY TO A CAMSHAFT". The benefit under 35 USC §119(e) of the United States provisional application is hereby claimed, and the aforementioned application is hereby incorporated herein by reference.

FIELD OF THE INVENTION

This invention relates to the use of cams in mechanical systems. More particularly, the invention pertains to means to add torsional energy to a camshaft to extend the range of a cam torque actuated cam phaser.

BACKGROUND OF THE INVENTION

A camshaft for use in an internal combustion engine of a type having spring loaded cam followers experiences a series of oppositely directed torque pulses during each revolution of the camshaft. The positive-going portion of each pulse occurs as a result of the need to apply torque to the camshaft to cause each of its operating cams to rotate against the force of the cam follower during the opening of the valve which is operated by such cam follower, and the negative-going portion occurs as the result of the application of an oppositely directed torque to the camshaft as the operating cam resists the force of the cam follower during the closing of the valve.

The resulting torque pulses can be used for actuation purposes, e.g., as a means for providing a control signal to a variable cam timing system (VCT) as disclosed in U.S. Pat. No. 5,002,023. The present invention incorporates by reference the disclosure of said U.S. patent.

For certain applications (usually inline 4-cylinder and 6-cylinder engines), however, the torque pulses may not be of sufficient magnitude for actuation of a VCT system according to U.S. Pat. No. 5,002,023. In these cases the torque pulses must be amplified to be utilized effectively.

The use of an additional cam lobe added to the length of the cam shaft is known.

U.S. Pat. No. 5,107,805 discloses a torque amplifying camshaft for operating a valve of each of a plurality valves of an internal combustion engine, the camshaft having an elongagted, shaftlike portion and an engine valve operating cam for each of the valves, the valve operating cams being spaced apart from one another along the shaftlike portion. Each of the engine valve operating cams has an outwardly projecting portion, and the outwardly projecting portions are circumferentially offset from one another about the longitudinal central axis of the camshaft. The camshaft also carries a supplementary cam surface, either in the form of an outwardly facing surface of a separate supplementary cam or an inwardly facing surface of a portion of a drive sprocket which is keyed to the shaftlike portion. The supplementary cam surface is adapted to be followed by a spring biased supplementary cam follower and has portions which introduce torque pulses into the camshaft which are synchronous with and consistently directed with respect to the torque pulses that are introduced into the camshaft by the engagement between the valve operating cams and spring biased followers which engage such valve operating cams.

U.S. Pat. No. 5,040,500 discloses a torque compensated camshaft for operating a valve of each of a plurality of valves of an internal combustion engine, the camshaft having an elongate shaftlike portion and an engine valve operating cam for each of the valves, the valve operating cams being spaced apart from one another along the shaftlike portion. Each of the engine valve operating cams has an outwardly projecting portion, and the outwardly projecting portions are circumferentially offset from one another about the longitudinal central axis of the camshaft. The camshaft also carries a compensating cam surface, either in the form of an outwardly facing surface of a separate compensating cam or an inwardly facing surface of a portion of a drive sprocket which is keyed to the shaftlike portion. The compensating cam surface is adapted to be followed by a spring biased compensating cam follower and has portions which introduce torque pulses into the camshaft which are synchronous with and oppositely directed with respect to the torque pulses that are introduced into the camshaft by the engagement between the valve operating cams and spring biased followers which engage such valve operating cams.

However, some additional cam lobe takes significant space such as extra length of a cam shaft. Many engines do not have the space for accommodating this type extra lobe in the engine compartment. Therefore, it is desirable to provide extra lobes that do not occupy excessive space in which the accommodating extra lobes are located.

SUMMARY OF THE INVENTION

A device that adds torsional energy to a camshaft is provided. The added torsional energy of the camshaft is used to extend the range a cam torque actuated (CTA) cam phaser. Furthermore, the added torsional energy of the camshaft may also be used to extend the range other types of phasers such as torque actuated (TA) as well.

A device that adds torsional energy to a camshaft without an additional cam lobe added to the length of the cam shaft is provided.

A device that adds torsional energy to a camshaft in which at least one extra lobe is formed on the cam shaft in which the extra lob requires very little extra room.

A device that adds torsional energy to a camshaft in which at least one pair of extra lobe is formed on the cam shaft in which the extra lob requires very little extra room.

Accordingly, a device for providing additional torsional energy for a cam shaft is provided. The device includes at least one main cam lobe formed on a rotating shaft; a valve operating mechanism disposed to be engaged by the main cam lobe; and an outer cylinder encompassing the valve operating mechanism, and capable of movement that is independent of the valve operating mechanism, the outer cylinder being disposed to provide torsional energy to the rotating shaft.

BRIEF DESCRIPTION OF THE DRAWING

FIG. 3B shows a schematic view of an alternative embodiment of the present invention corresponding to FIG. 3A.

DESCRIPTION OF THE PREFERRED EMBODIMENT

This section includes the descriptions of the present invention including the preferred embodiment of the present invention for the understanding of the same. It is noted that the embodiments are merely describing the invention. The claims section of the present invention defines the boundaries of the property right conferred by law.

Figure 1:
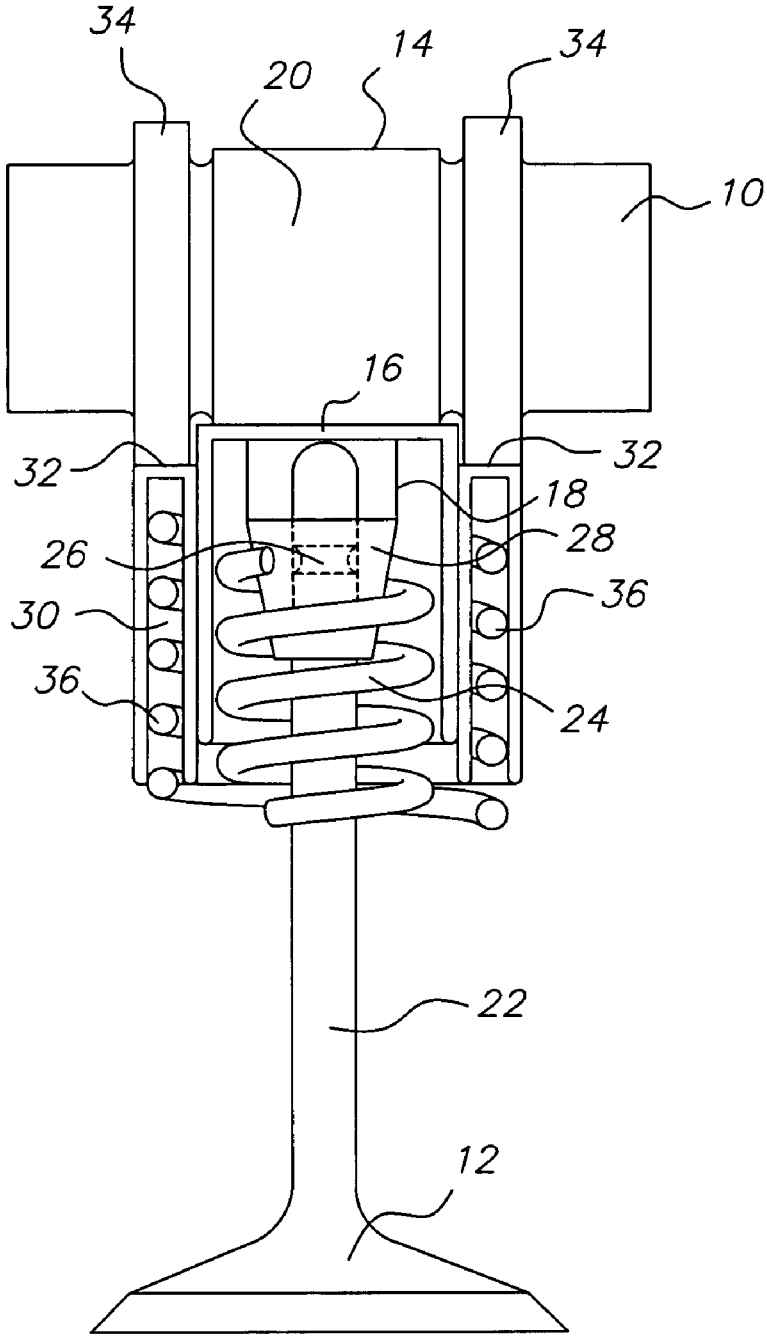
FIG. 1 shows a first perspective view of the present invention.
Figure 1A:
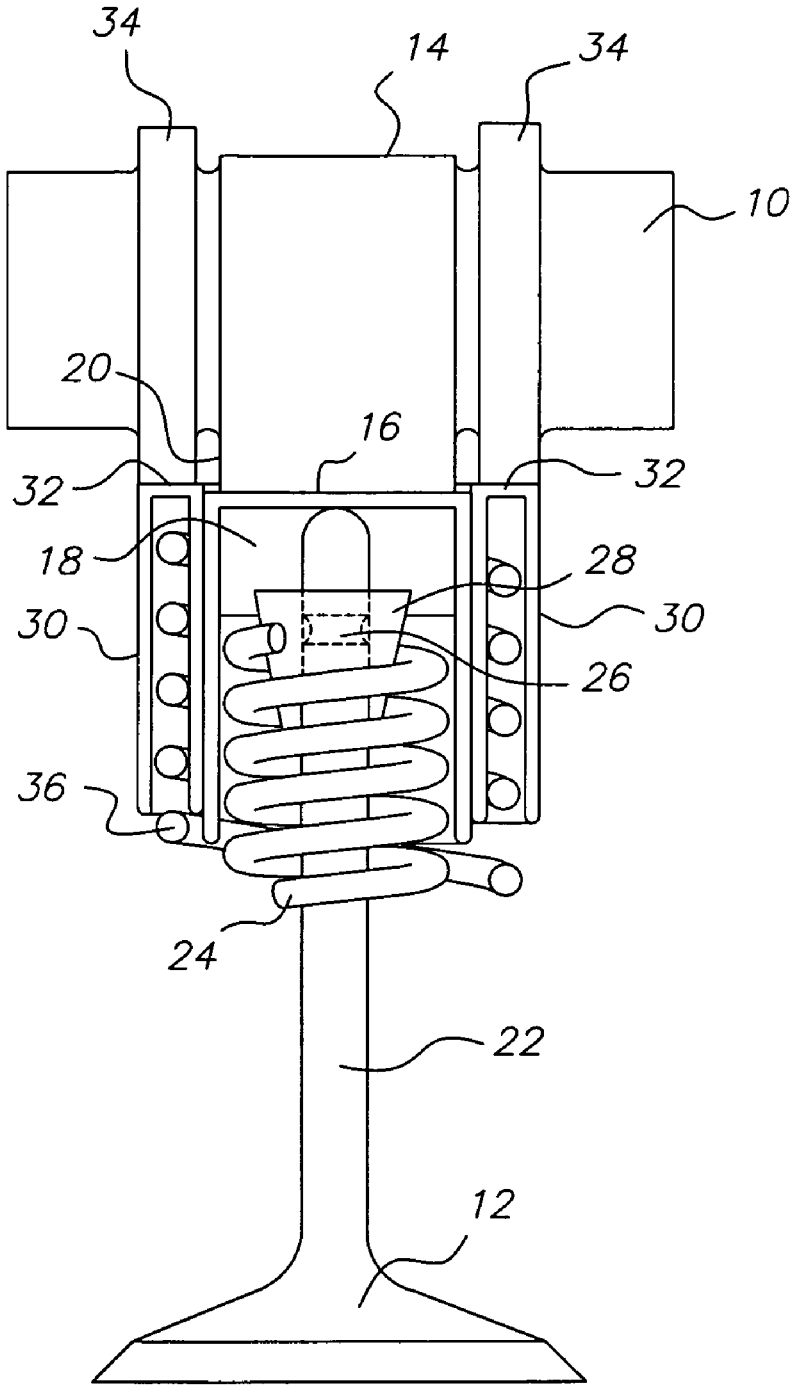
FIG. 1A shows a second perspective view of the present invention.

Referring to FIGS. 1 and 1A, a set of perspective views of the present invention is shown. A cam shaft (10) having a plurality of cam lobes (only one (14) shown) formed thereon for controlling valves such as valve (12) is provided. Cam shaft (10) may control valve (12) in any known manner. For example, main cam lobe (14) may rotably engage a top surface (16) of an inverted bucket mechanical lifter (18). During the rotation, due to the suitable shape of main cam lobe (14) including its cam nose (20), valve (12) opens or closes as desired. Valve (12) includes a valve stem (22) having an elongated shape with one end coupled to a valve spring (24). The coupling is achieved via a lock groove (26) on the one end of valve stem (22), in which the lock groove (26) facilitates the positioning of a valve guide or keeper (28).

An outer cylinder (30) encompasses or holds the above described elements within itself, i.e. within outer cylinder (30). Outer cylinder (30) has a top engaging surface (32) that suitably engages a pair of accompanying cam lobes (34) formed on cam shaft (10) at each side of main cam lobe (14). Outer cylinder (30) may be a hollow member having a cylinder spring (36) positioned within the hollow. Alternatively, cylinder spring (36) may be at other suitable locations such as on top or below outer cylinder (30). Cylinder spring (36) is independent of valve spring (24). Further, mechanical lifter (18) is not rigidly connected to outer cylinder (30). Mechanical lifter (18) can move or slide relative to outer cylinder (30).

The mechanism within the outer cylinder (30) is also known as a valve operating mechanism. The valve operating mechanism is not limited to the description herein; it can be any known valve operating mechanism.

Referring specifically to FIG. 1, the first perspective view of the present invention wherein cam nose (20) is not engaging top surface (16) of mechanical lifter (18) is depicted. In other words, as cam shaft (10) rotates cam nose (20) is not pressing valve (12) downward.

Referring specifically to FIG. 1A, the second perspective view of the present invention wherein cam nose (20) is engaging top surface (16) of mechanical lifter (18) is depicted. In other words, as cam shaft (10) rotates cam nose (20) is pressing valve (12) downward.

Figure 2:
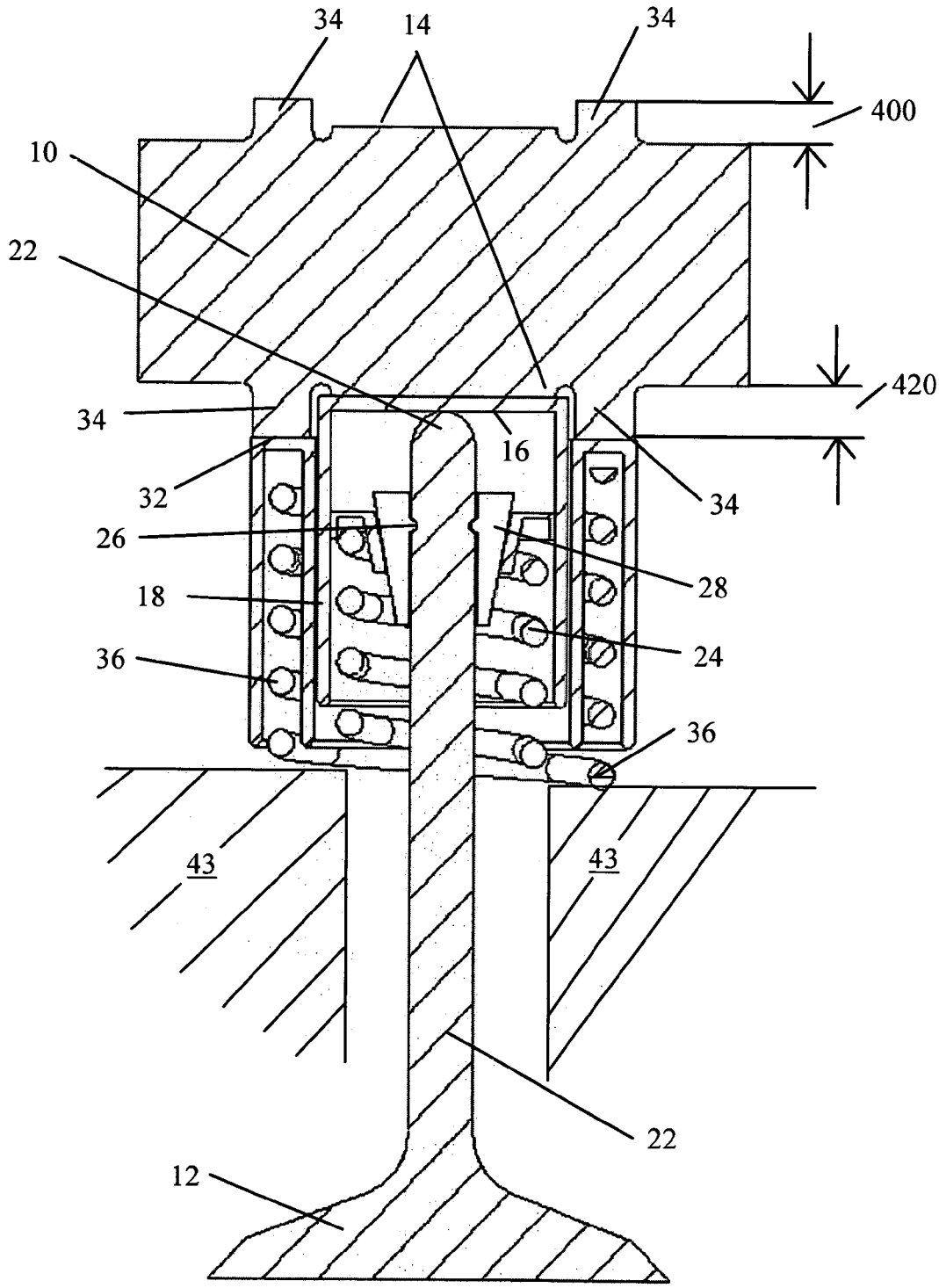
FIG. 2 shows a first elevational, sectional view of the present invention.
Figure 2A:
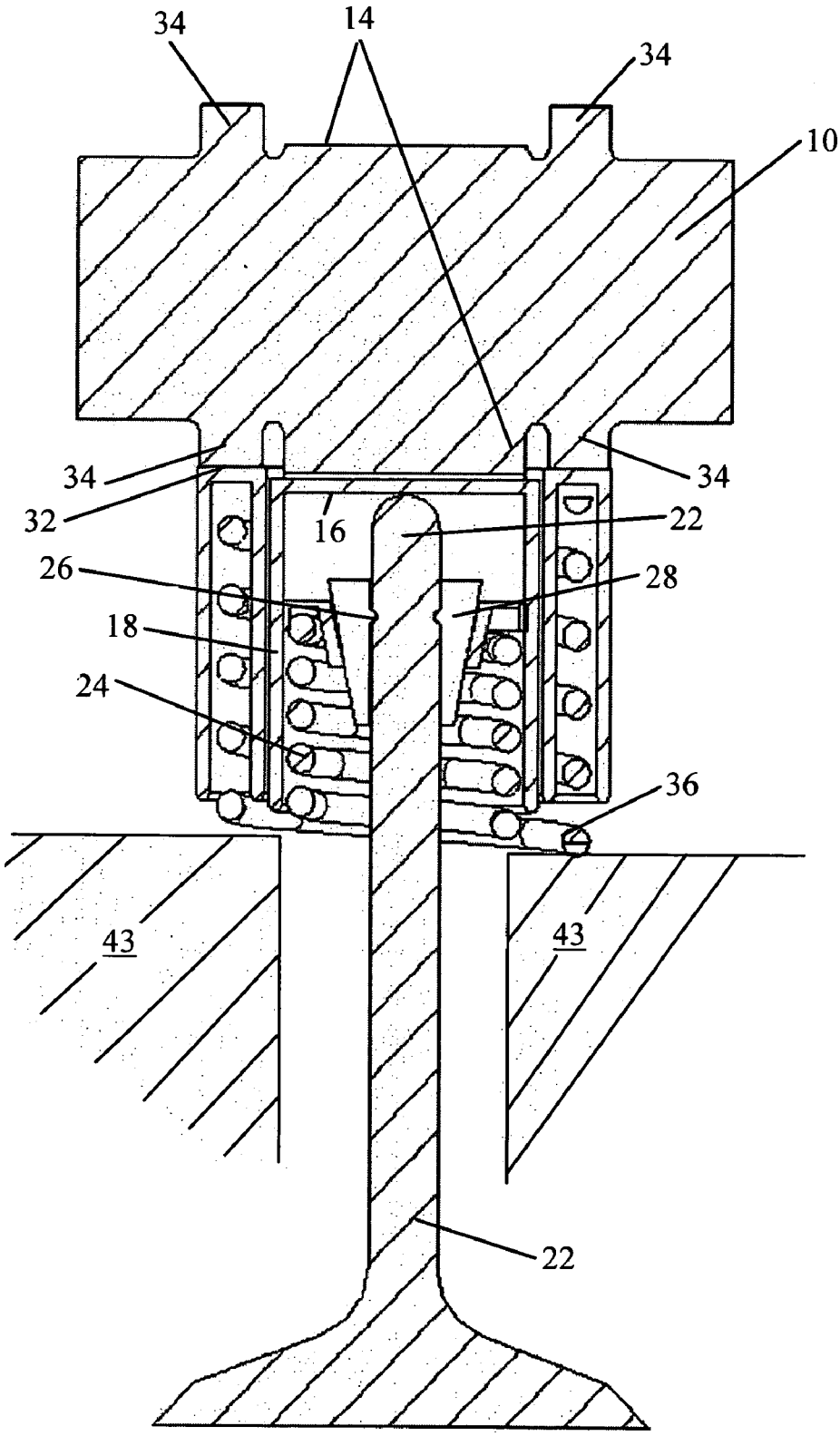
FIG. 2A shows a second elevational, sectional view of the present invention.

Referring to FIGS. 2 and 2A, a set of elevational, sectional views of the present invention is shown. Main cam lobe (14) is formed on cam shaft (10) as a single member or block. Similarly, the pair of accompanying cam lobes (34) is formed on cam shaft (10) as a single block as well. Accompanying cam lobes (34) rotably engage top engaging surface (32) of outer cylinder (30). Accompanying cam lobes (34) possess a cam shape wherein under most circumstances the engagement of accompanying cam lobes (34) with outer cylinder (30) at different positions (e.g. 2 positions) of rotation of cam shaft (10) corresponds to a pair of different relative distances between a center of cam shaft (10) and top engaging surface (32). This may be shown by the difference in length of an upper gap (400) and a lower gap (420).

In addition, valve (12) has valve stem (22). On valve stem (22) lock groove (26) is formed thereon for keeper (28) to secure valve spring (24). Mechanical lifter (18) has top surface (16) for receiving action from main cam lobe (14). Outer cylinder (30) has cylinder spring (36) for aiding the generation of torsional energy. Cylinder spring (36) is independent of valve spring (24). Further, outer cylinder (30) can move freely relative to mechanical lifter (18). In other words, outer cylinder (30) can move freely relative to mechanical lifter (18). As can be seen, this free movement is a key feature needed for the generation of torsional energy of the present invention.

Outer cylinder (30) may be rested on the engine block (43), or some other member (not shown) interposed between engine block (43) and outer cylinder (30). As can be seen, a line of force (not shown) can be achieved wherein the force conjoins or is being exerted upon each of the members including cam lobes (34), additional cylinder (30) via engaging surface (32), cylinder spring (36), and engine block (43). Through this line of force, additional torsional energy are provided for the cam shaft (10).

Referring specifically to FIG. 2, the first perspective view of the present invention wherein cam nose (20) is not engaging top surface (16) of mechanical lifter (18) is depicted. In other words, as cam shaft (10) rotates cam nose (20) is not pressing valve (12) downward.

Referring specifically to FIG. 2A, the second perspective view of the present invention wherein cam nose (20) is engaging top surface (16) of mechanical lifter (18) is depicted. In other words, as cam shaft (10) rotates cam nose (20) is pressing valve (12) downward.

Figures 3, 3A:
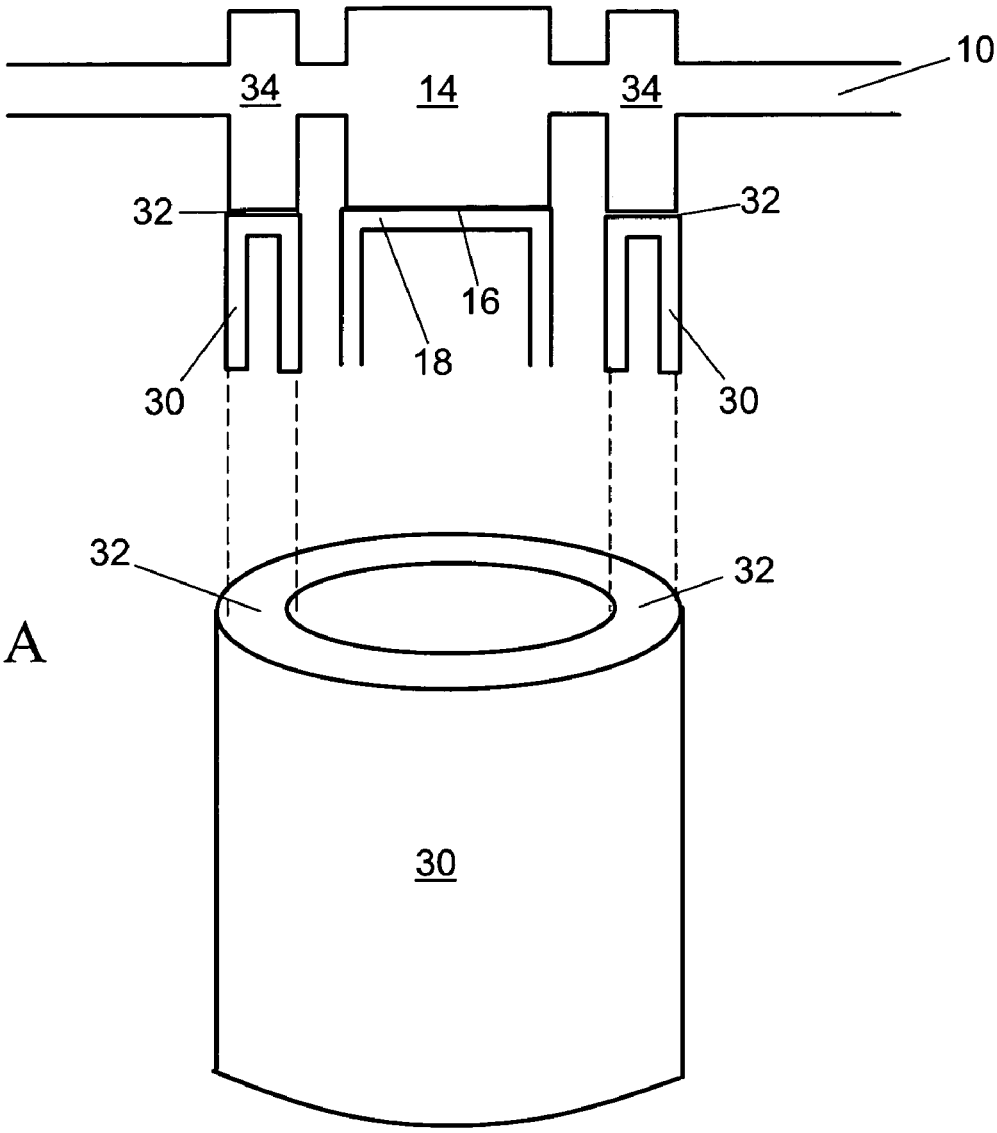
FIG. 3 shows a first schematic view of the present invention.
FIG. 3A shows a second schematic view corresponding the FIG. 3.

Referring to FIGS. 3 and 3A, a set of schematic views of the present invention is shown. Cam shaft (10) has main cam lobe (14) and a pair of accompanying cam lobes (34) formed thereon. Main cam lobe (14) is engaging mechanical lifter (18) and the pair of accompanying cam lobes (34) is respectively engaging top engaging surface (32).

Referring specifically to FIG. 3A, outer cylinder (30) that encompasses mechanical lifter (18) is shown. Mechanical lifter (18) may include therein any suitable known valve operating mechanism.

Figure 4:
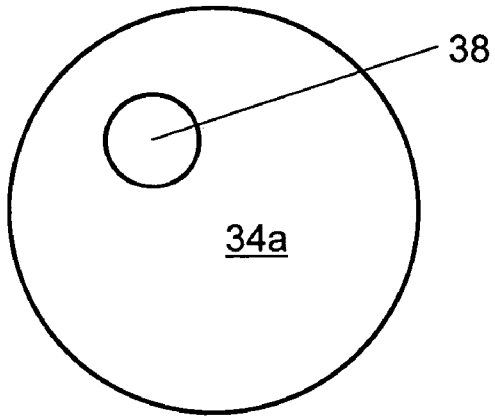
FIG. 4 shows a first embodiment of accompany cam lobe.

Referring to FIG. 4, a first embodiment (34*a*) of accompany cam lobe is shown. First embodiment (34*a*) is a circle or round disk that is non concentric having a first center region (38). Center (38) is aligned with a center line (not shown) of cam shaft (10). As center (38) rotates in line with the centerline of cam shaft (10), any two points on the circumference of the non concentric disk, or first embodiment (34*a*) apparently each has an unequal distance to a center point of center (38). Therefore, the cam shape of first embodiment (34*a*) with its concomitant characteristics forms the necessary basis for the generation of torsional energy of the cam shaft (10).

Figure 4A:
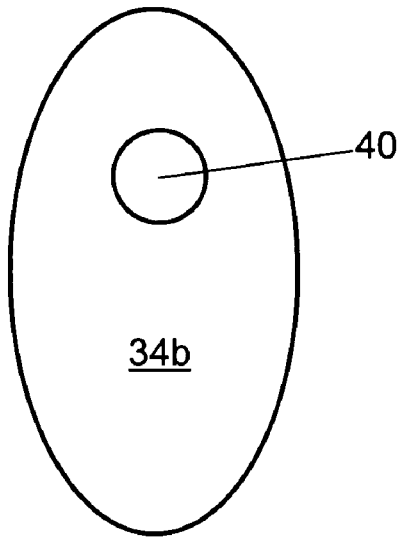
FIG. 4A shows a second embodiment of accompany cam lobe.

Referring to FIG. 4A, a second embodiment (34*b*) of accompany cam lobe is shown. The second embodiment (34*b*) is an oval shaped disk having a center region (40) which may or may not the physical center of the disk. Second center (40) is aligned with a center line (not shown)

of cam shaft (10). As second center (40) rotates in line with the centerline of cam shaft (10), any two adjacent points on the circumference of the oval disk, or second embodiment (34*b*) apparently each has an unequal distance to a center point of second center (40). Therefore, the cam shape of second embodiment (34*b*) with its concomitant characteristics forms the necessary basis for the generation of torsional energy of the cam shaft (10).

As can be seen, in a specifically exemplified embodiment of the present invention, a means may be provided for adding torsional energy to a camshaft to extend the range of a cam torque actuated Cam Phaser. Instead of adding an extra cam lobe which may significantly extend the length of the cam shaft, an extra lobe that requires very little extra room is provided in the immediate neighborhood of at least on existing cam lobe. As can be seen, an additional full fledged cam lobe may significantly add to the length of the cam shaft. Many engines do not have the space within the engine compartment to accommodate this additional full fledged lobe.

The present invention provides one or more extra lobes that requires very little extra room. The present invention further includes a cylinder such as outer cylinder (30) being added around an inverted bucket mechanical lifter (e.g. mechanical lifter (18)) with a spring (e.g. 36) encased inside outer cylinder (30). Two extra lobes such as accompanying cam lobes (34) are added on either side of the main valve lobe such as main cam lobe (14). These accompanying cam lobes (34) may be as simple as circle that is non concentric (see FIG. 4). Or alternatively, accompanying cam lobes (34) may be of the same shape as the main cam lobe (14) that opens and closes the valve (12).

On a four cylinder engine, the torsional energy from this type of lobe taught by the present invention will help actuate the Cam Torque Actuated Phaser at higher speeds when the forth order of cam torsional energy is decreasing. Experiments have shown an increase in CTA Phaser actuation range by adding the extra lobe (34).

Figure 5:
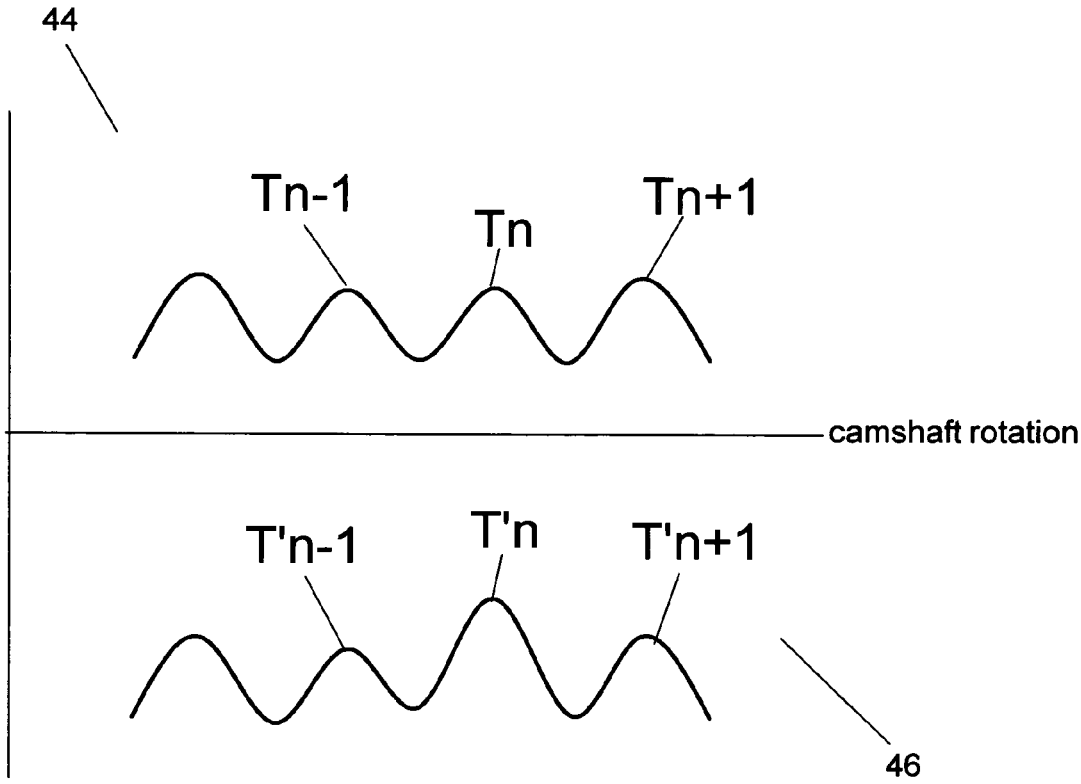
FIG. 5 shows a graph comparing prior art with the present invention.

FIG. 5 is a set of graphs depicting a comparison of systems with and without the present invention. As a cam shaft rotates, torques are generated by the set of cam lobes thereon. Graph (44) shows torques of about the same intensity. For example, torque T possesses about the same intensity as that of torques $T_{n-1}$, or $T_{n+1}$. On the other hand, Graph (46) shows torques having different intensity. For example, torque T' possesses torque having different intensity as that of torques $T'_{n-1}$, or $T'_{n+1}$. As can be seen, $T'_n$ has more torsional engergy than $T_n$. $T'_n$ is generated as a result of the structures taught in the present invention. Whereas, $T_n$, similar to other torques such as $T_{n-1}$, $T_{n+1}$, $T'_{n-1}$, or $T'_{n+1}$, are generated by structure not incorporating the present invention.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A device comprising:

at least one main cam lobe formed on a rotating shaft;

a valve operating mechanism disposed to be engaged by the main cam lobe;

an outer cylinder surrounding the valve operating mechanism, and capable of movement that is independent of the valve operating mechanism, the outer cylinder being disposed to provide torsional energy to the rotating shaft; and at least one accompanying cam lobe formed on the rotating shaft, adjacent to the main cam lobe, and engages a top surface of the outer cylinder.

2. The device of claim 1, wherein the at least one accompanying cam lobe comprises a pair of lobes disposed at each side of the main cam lobe along the rotating shaft, such that the pair of lobes occupies a limited space along the length of the camshaft.

3. The device of claim 1 wherein the at least one accompanying cam lobe is a round disk having a non-concentric center region coupled to and rotate along with the rotating shaft.

4. The device of claim 1 wherein the at least one accompanying cam lobe is an oval shaped disk having a center region coupled to and rotate along with the rotating shaft.

5. The device of claim 1, wherein the accompanying lobe comprises an extra width portion of the main cam lobe, such that the extra width of the main cam lobe engages the outer cylinder for the provision of torsional energy upon the rotating shaft.

6. The device of claim 1 further comprising an elastic member disposed along a line of force transmission between the outer cylinder and a seat on an engine block.

7. The device of claim 6, wherein the elastic member is a cylinder spring disposed within the outer cylinder which possesses a hollow space therein.

* * * * *